US006951325B2

(12) United States Patent
Lopez-Apodaca

(10) Patent No.: US 6,951,325 B2
(45) Date of Patent: Oct. 4, 2005

(54) FOREARM AND WRIST SUPPORT FOR COMPUTER KEYBOARD OPERATORS

(76) Inventor: Ruben Lopez-Apodaca, 829 S. Philadelphia St., Anaheim, CA (US) 92805

( * ) Notice: Subject to any disclaimer, the term of this patent is extended or adjusted under 35 U.S.C. 154(b) by 1 day.

(21) Appl. No.: 10/782,139

(22) Filed: Feb. 20, 2004

(65) Prior Publication Data

US 2005/0184204 A1 Aug. 25, 2005

(51) Int. Cl.[7] ..... B43L 15/00
(52) U.S. Cl. ..... 248/118.1; 248/118; 248/917
(58) Field of Search ..... 248/118, 118.1, 248/118.3, 917, 918

(56) References Cited

U.S. PATENT DOCUMENTS 2,477,898 A * 8/1949 Rehman et al. ..... 248/118
5,678,800 A * 10/1997 Markussen ..... 248/346.01
5,833,180 A * 11/1998 Baranowski ..... 248/118
5,848,773 A * 12/1998 Bourassa ..... 248/298.1
D423,482 S * 4/2000 Eddins ..... D14/458
6,070,838 A * 6/2000 Luginsland ..... 248/118.5
6,109,571 A * 8/2000 Hirschovits et al. ..... 248/118
D442,603 S * 5/2001 Lam ..... D14/458
6,362,809 B2 * 3/2002 Mattson ..... 345/156
6,467,737 B1 * 10/2002 Dorantes ..... 248/118
6,471,164 B2 * 10/2002 DiOrio ..... 248/118
6,527,234 B1 * 3/2003 Kovacik ..... 248/118.1
6,749,277 B2 * 6/2004 Michaels ..... 312/334.5

* cited by examiner

*Primary Examiner*—Ramon O. Ramirez
*Assistant Examiner*—Steven Marsh
(74) *Attorney, Agent, or Firm*—Seto Patents; Jeffrey K. Seto

(57) ABSTRACT

A forearm and wrist support apparatus for keyboard operators. The support apparatus attaches to a working surface and provides a comfortable resting place for the forearms of the keyboard operator. A supporting base of the apparatus comprises of a rigid lower member, side members attached to left and right sides of the lower member, and a sloping front member. Each side member includes a horizontal slot that forms a track for a sliding arm support that is housed within the apparatus. The sliding arm support has a flat rectangular shape and includes tabs on both sides to extend and retract the sliding arm support. The apparatus further includes a cushion comprising a pad attached to the front and side members that extends to the rear of the apparatus. A cover material covers the external surfaces of the front and side members. The apparatus also includes an attachment system comprising a screw clamp attached to the lower surface of the apparatus.

8 Claims, 5 Drawing Sheets

FOREARM AND WRIST SUPPORT FOR COMPUTER KEYBOARD OPERATORS

BACKGROUND OF THE INVENTION

The present invention relates generally to office equipment and specifically relates to an arm and wrist support for keyboard operators.

One aspect of modern life is the increasing use of computers in the home and in the office. It is not uncommon for people to spend long periods of time entering information via a computer keyboard. At a typical computer workstation, the keyboard is located near the front edge of a desk or other working surface. The keyboard operator sits in front of the desk, and operates the computer keyboard. There are several postures that a keyboard operator may assume to allow him to work at the keyboard.

The operator may attempt to type by holding his hands over the keyboard without any support. In this position, the weight of the forearms is born by the wrists and shoulders. This position produces fatigue and stresses on the ligaments of the wrists and may cause soreness and even ligament damage which is expensive and difficult to treat. When sitting in this position for extended periods of time the operator may lean forward while operating the computer resulting in poor posture possibly leading to back pain.

Alternatively operators may rest a portion of their forearms on the desk. This position requires setting the keyboard further away from the front edge of the desk taking up valuable space on the desk. In this position, the forearms are supported mainly by the relatively sharp edge of the desk, which results in discomfort. Also in this position, the keyboard operator must elevate his wrists above the desk to type which leads to fatigue of the wrists and unwanted stress on the wrist ligaments.

SUMMARY OF THE INVENTION

A device for supporting the wrists and forearms of computer users while they are entering data at a computer keyboard. The device is comprised of a supporting base, a front member, side vertical members, a sliding arm support, a cushion, and an attachment system. The supporting base is comprised of a flat supporting surface, two vertical side members attached to each side of the supporting surface, and a rear member attached to the rear edge of the supporting surface. Each member of the supporting base is made of a strong rigid material.

In use a device is supplied for each hand of the user. The supporting base of the apparatus is placed on the front edge of a desk. The front of the apparatus faces the computer keyboard while the rear of the apparatus is nearest the user. The bottom of the supporting base is covered with a sheet of rubber so that friction between the rubber and the desk reduces the tendency of the device to slide on the desk. The supporting base has a slot that extends down the middle of the supporting base from the rear edge towards the front of the supporting base. This slot forms a track for the sliding arm support.

The sliding arm support is flat with a width substantially the same but smaller than the width of the supporting base. The sliding arm support has a T-shaped tab that engages the slot in the supporting base. The sliding arm support also has tabs extending from the side edges near the rear edge. Each vertical side member has a horizontal slot that extends for most of the length of the side member. The tabs of the sliding arm support slidably engage the slots of the vertical members.

The rear member may be vertical or may be angled toward the front edge of the supporting base.

A cushion is provided on which the wrists and forearms of the user are rested. The cushion is comprised of a soft, weight absorbing material pad. The pad is attached to the rear and side vertical members and covers the area above the supporting base. The cushion further comprises a cover for the exterior of the front and sides of the apparatus.

The attachment means fixes the device to a desk or other working surface. In one embodiment, the attachment means consists of a screw clamp attached to the lower surface of the supporting base. The surface of the "foot" of the clamp is covered with rubber so that the clamp can engage the lower surface of the desk without causing damage.

It is an object of the present invention to provide a comfortable support to the wrists and forearms of a computer user so that stress and fatigue are reduced when the user operates the computer for extended periods.

It is an object of the present invention to provide a support that adjusts to different arm lengths of users and that minimizes the amount of real estate taken up on a working surface or desk.

BRIEF DESCRIPTION OF THE DRAWINGS

The invention of the present application will now be described in more detail with reference to the accompanying drawings, given only by way of example, in which.

DETAILED DESCRIPTION OF THE INVENTION

Figure 1:
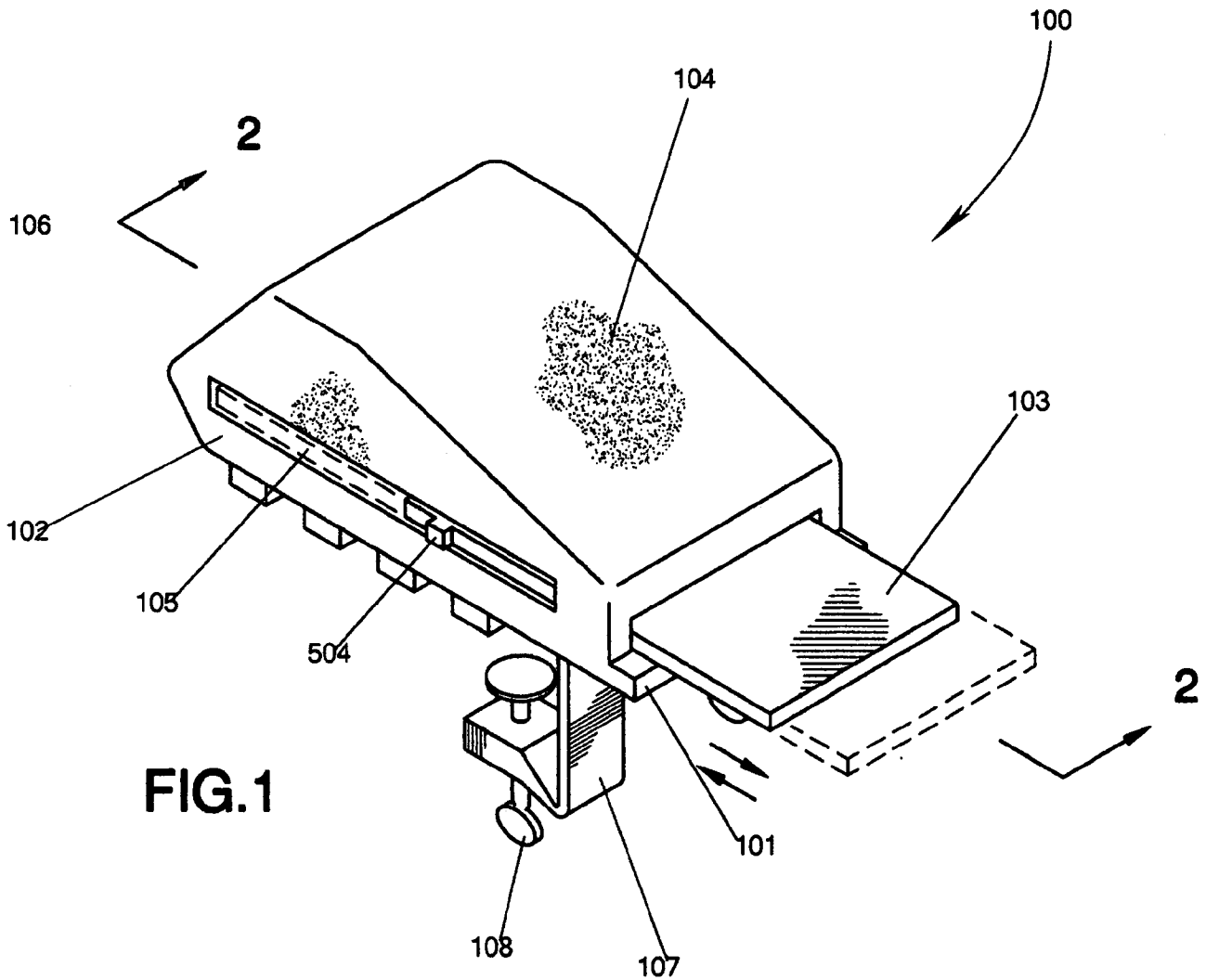
FIG. 1 is a perspective view of the preferred embodiment of the invention.

In the accompanying drawings, like numerals are used to designate like parts. FIG. 1 provides an overall view of the device 100. The supporting base comprises a flat lower member 101, and a pair of vertical side members 102. Each member of the supporting base is made of a strong rigid material.

Figure 5:
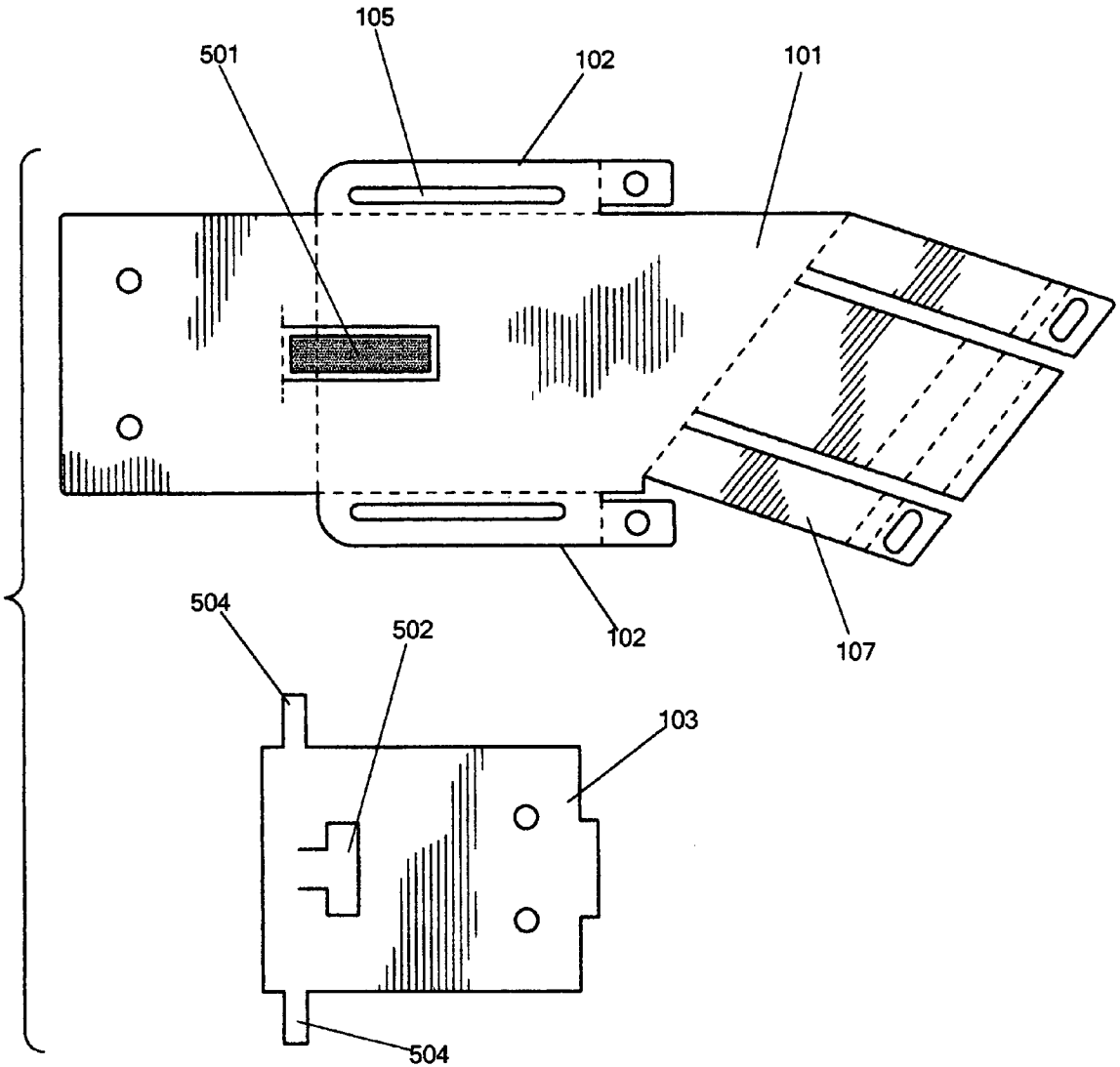
FIG. 5 shows preassemblies used to make one embodiment of the invention.

As shown in FIG. 1 and FIG. 5, attached to each side of the lower member 101 are vertical side 102 members. The side members 102 are made of a strong rigid material. Each side member 102 comprises a horizontal slot 105. The horizontal slots 105 are parallel to each other and form tracks for a sliding arm support 103. The lower member 101 is provided with a slot 501 extending from the front edge, of the lower member extending towards the rear of the lower member 101. The slot 501 in the lower member 101 provides a track for the sliding arm support 103 of the apparatus.

Figure 2:
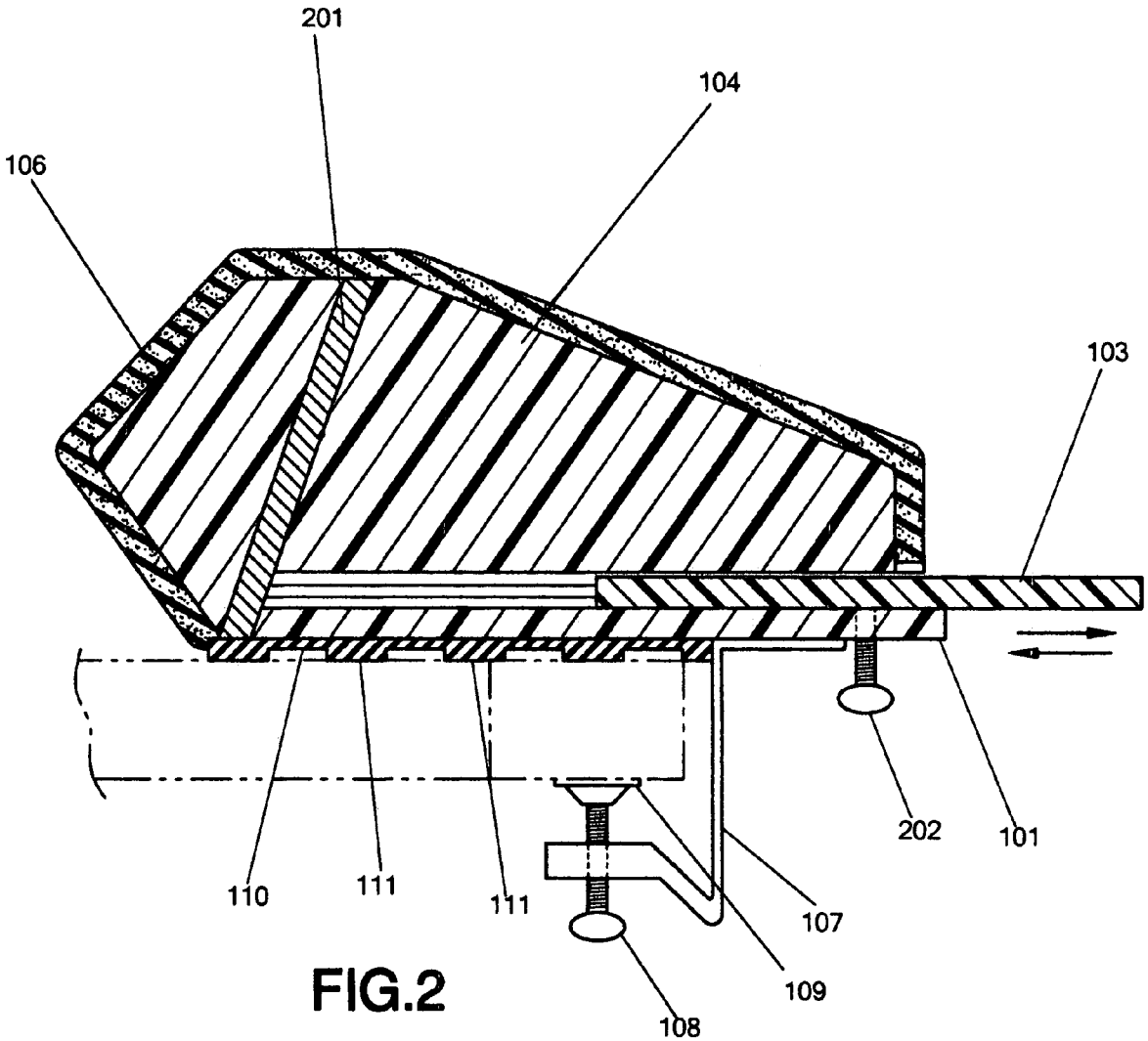
FIG. 2 is a cross sectional view showing the slide mechanism.

FIGS. 1, 2, and 5 best show the details of the sliding arm support 103. The sliding arm support 103 is substantially rectangular in shape. The width of the sliding arm support is substantially the same as but less than the width of the lower member so that the sliding arm support, 103 can move forwards and backwards within the region contained within the vertical side members 102. A "T" shaped tab 502 is attached to the lower surface of the sliding arm support near the front edge and centered within the width of the sliding arm support 103. The "T" shaped tab 502 slideably engages the slot 501 in the lower member 101 of the supporting base. A rectangular tab 504 is provided on each side of the sliding arm support near the front edge. Each rectangular tab 504 slideably engages the corresponding slot 105 of the corresponding vertical member 102 of the supporting base.

The length of the slots 105 in the side members and of the slot 501 in the lower member, and the length of the sliding arm support determine the extent to which the sliding arm support 103 can extend beyond the rear edge of the supporting base. This length is an effective sliding distance that allows the extending the sliding arm support 103 out beyond the end of the supporting base to comfortably support the forearms of computer users, while also allowing the sliding arm support to be retracted into the interior of the apparatus. In the preferred embodiment the sliding arm support 103 can extend approximately 5 inches beyond the supporting base and can be retracted until it is substantially flush with the front edge of the lower member of the support base. The sliding arm support 103 provides support for the forearms of the user and can be extended to provide additional arm support and retracted to provide a more compact device arrangement.

As shown in FIGS. 2 and 5, the supporting base further comprises a front member 201. The front member 201 is attached to the front edge of the lower member 101. The front member 201 forms an angle with the lower member 101 and slants towards the rear edge of the supporting base. In the preferred embodiment, the angle formed between the lower member and the front member is approximately 70 degrees.

In one embodiment, a screw 202 is threaded up through the lower surface of the lower member 101 near the front edge. In use this screw is tightened to lock the sliding arm support 103 into the desired position.

A cushion is provided to provide a comfortable resting place for the wrist and forearms of the user. The cushion comprises a pad 104 made of a soft material attached to the front member 201 and the side members 102. The cushion further comprises a flexible cover 106, which covers the front member and the vertical side members of the supporting base.

The apparatus further comprises an attachment system adapted to secure the device to a working surface. The attachment system comprises a clamp support 107 attached to the front edge of the lower member 101 of the supporting base, and a screw clamp 108 threaded through the clamp support 107. The top surface of the screw clamp is covered with rubber 109 so that when tightened the clamp effectively secures the apparatus to a work surface without causing damage to the work surface.

In the preferred embodiment, the lower surface of the lower member 101 of the supporting base is substantially covered with a sheet of rubber 110. In one embodiment, the rubber is provided with a plurality of rubber feet 111 of rectangular cross section, each extending along the width of the rubber sheet. In use the rubber sheet provides friction between the apparatus and the working surface that reduces the tendency of the apparatus to slide across the working surface.

Figure 3:
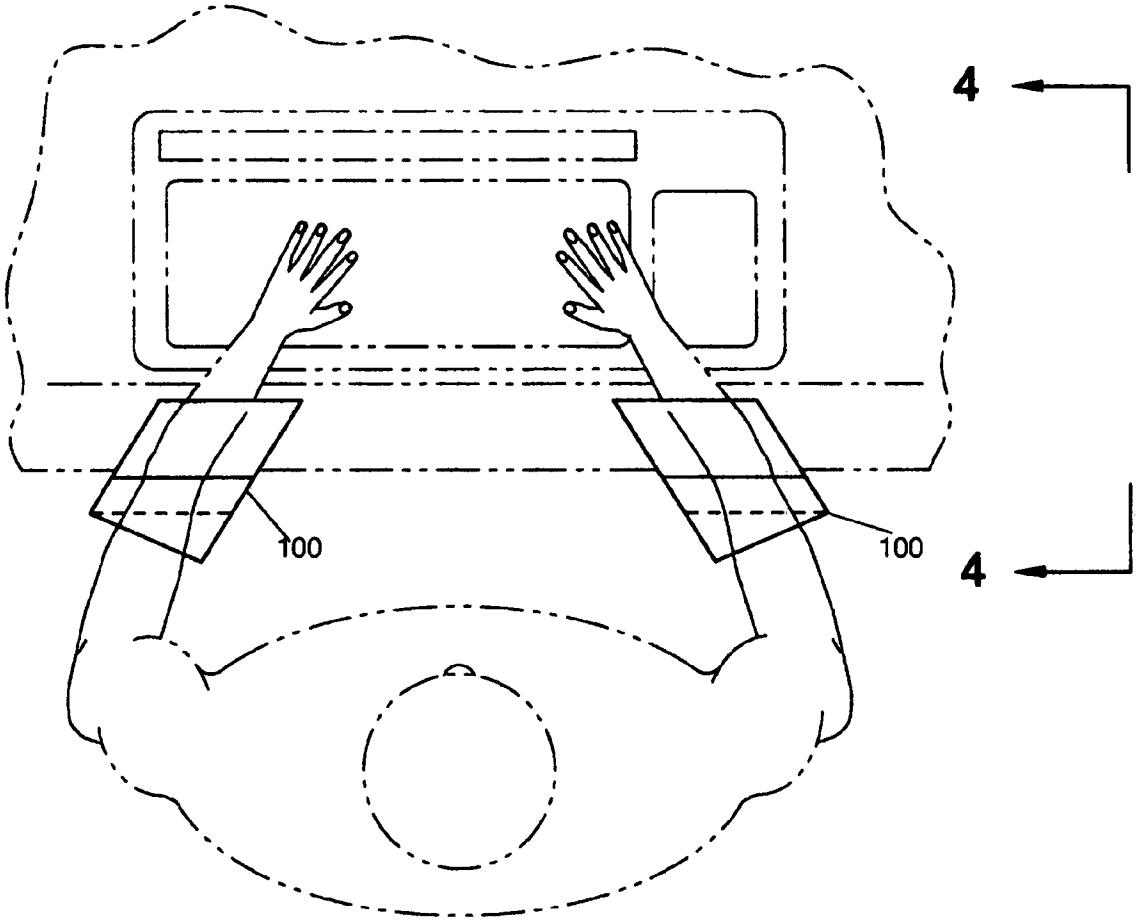
FIG. 3 is a top view showing the preferred embodiment of the invention in use.

FIG. 3 is a top view shows the device 100 in use. In use, a device is provided for each hand. The overall width of the device is wider than the wrist and forearms of the typical user. The device width is also sufficient to allow access to at least half of the keys of the keyboard while an operator's hand is still resting comfortably on the pad of the device. In one embodiment the overall width of the apparatus is approximately 4 inches.

Figure 4:
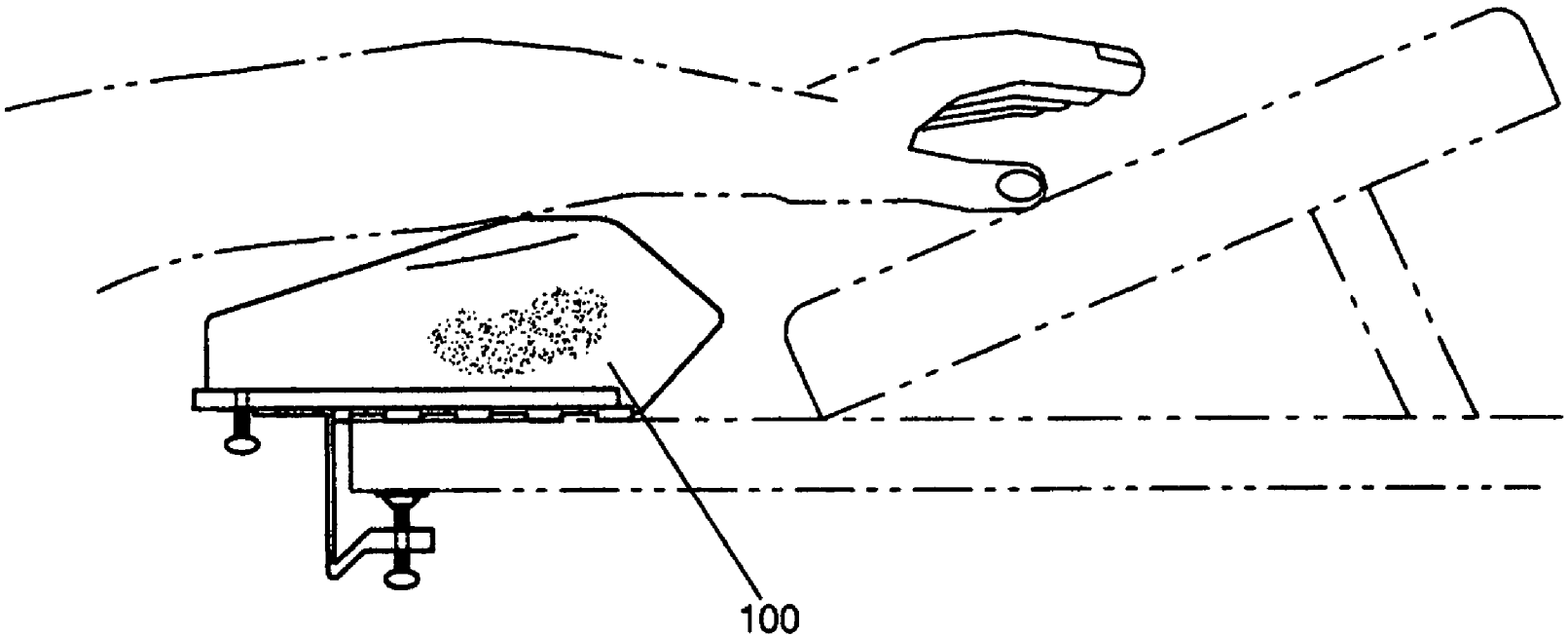
FIG. 4 is a side view showing the desk attachment mechanism.

FIG. 4 is a side view showing the device in use. The overall height of the apparatus is such that an operator's arm can reach keys at the lower and upper portion of a keyboard while the wrist or forearm is in contact with the apparatus. In one embodiment, the overall height of the device is approximately 3 inches.

The foregoing description of the specific embodiments will so fully reveal the general nature of the invention that others can, by applying current knowledge, readily modify and/or adapt for various applications such specific embodiments without departing from the generic concept. Therefore, such adaptations and modifications should and are intended to be comprehended within the meaning and range of equivalents of the disclosed embodiments. It is to be understood that the phraseology of terminology employed herein is for the purpose of description and not of limitation.

I claim:

1. A forearm support apparatus for computer keyboard operators comprising;

a supporting base that includes;

a flat rigid horizontal lower member with a slot extending a distance from a front edge of the horizontal lower member to a rear portion of said horizontal lower member;

a vertical side member attached to each side of the horizontal lower member, each side member extending substantially the entire length of the horizontal lower member and each side member provided with a horizontal slot of a sliding length;

a front member attached to the front edge of the horizontal lower member;

a horizontal sliding arm support that includes;

a flat horizontal surface made of a rigid material, a width of the flat horizontal surface being substantially the same but slightly less than the width of the horizontal lower member;

tabs attached to each side and near a front end of the sliding arm support, each tab of said sliding arm support engaging respective slots in the vertical side members of the supporting base;

a cushion comprising;

a pad made of soft flexible material that substantially covers a top of the supporting base;

a cover that substantially covers the pad; and, an attachment system attached to the horizontal lower member of the supporting base for securing the apparatus to a horizontal work surface, wherein a screw is threaded up through the front edge of the supporting base to aid holding the sliding arm in place.

2. The apparatus of claim 1, wherein the width of the supporting base is approximately 4–6 inches.

3. The apparatus of claim 1, wherein the overall height of the apparatus is approximately 2–3 inches.

4. The apparatus of claim 1, wherein the sliding arm support when fully extended extends 5 inches past the rear edge of the lower member of the supporting base.

5. The apparatus of claim 1, wherein the horizontal sliding arm support also includes a T-shaped tab attached to a lower surface of the sliding arm support near the front end of said sliding arm support, the tab engaging the slot in the lower member of the supporting base.

6. The apparatus of claim 1, wherein one or more strips of rubber are attached to the horizontal lower member of the supporting base.

7. The apparatus of claim 1, wherein an angle of the vertical member with respect to the horizontal lower member is approximately 70 degrees sloping towards the rear of the apparatus.

8. The apparatus of claim 1, wherein the attachment system is comprised of a screw clamp, a clamping surface of said clamp being covered with rubber.

* * * * *